US005131476A

United States Patent [19]

Harrington

[11] Patent Number: 5,131,476

[45] Date of Patent: Jul. 21, 1992

[54] DOWN HOLE PERCUSSION DRILL APPARATUS

[75] Inventor: Kevin E. Harrington, Houston, Tex.

[73] Assignee: Percussion Drilling, Inc., Houston, Tex.

[21] Appl. No.: 629,606

[22] Filed: Dec. 18, 1990

[51] Int. Cl.[5] ..... B23Q 5/033; E21C 7/04

[52] U.S. Cl. ..... 173/17; 173/73; 173/78; 173/80; 173/135; 91/234

[58] Field of Search ..... 173/17, 73, 66, 80, 173/135, 136, 137; 91/234

[56] References Cited

U.S. PATENT DOCUMENTS

| | | | |
|---|---|---|---|
| 2,859,733 | 11/1958 | Bassinger . | |
| 2,947,519 | 8/1960 | Feucht . | |
| 3,111,176 | 11/1963 | Wilder . | |
| 3,136,375 | 6/1964 | Lear . | |
| 3,198,264 | 8/1965 | Oelke . | |
| 3,410,353 | 11/1968 | Martini . | |
| 3,527,239 | 9/1970 | Boom | 173/17 |
| 3,606,930 | 9/1971 | Curington . | |
| 3,804,181 | 4/1974 | Curington . | |
| 3,826,316 | 7/1974 | Bassinger . | |
| 3,958,645 | 5/1976 | Curington | 173/17 |
| 4,084,646 | 4/1978 | Kurt . | |
| 4,333,537 | 6/1982 | Harris et al. | 173/17 |
| 4,530,408 | 7/1985 | Toutant | 173/17 |

FOREIGN PATENT DOCUMENTS 307184 9/1971 U.S.S.R. .

OTHER PUBLICATIONS

Walter E. Liljestrand, Mission Manufacturing report, paper presented to 19th Annual Meeting of the American Association of Oilwell Drilling Contractors, Oct. 13, 1959 at Oklahoma City, Okla.

*Primary Examiner*—Douglas D. Watts

*Assistant Examiner*—Scott A. Smith

*Attorney, Agent, or Firm*—Dodge, Bush, Moseley & Riddle

[57] ABSTRACT

A downhole percussion drill or hammer (100) is disclosed having an outer casing (2) in which a reciprocating piston (26) which periodically impacts a drilling bit (16) disposed at a bottom end of the casing. A top chuck (1), attached to the top end of the casing, conducts pressurized air to the interior of the casing. A flow tube (5) includes a supply passage (27) and an exhaust passage (10). No cylinder sleeve exists between the inner diameter of the casing (2) and the outer diameter of the piston (26). Rather, the flow tube (5), piston (26) and interior structure of the casing cooperate to direct pressurized air alternately to the top and bottom ends of the piston while alternately opening and closing the exhaust passage. Accordingly, for a predetermined outer casing diameter, a relatively thicker casing wall and relatively larger top piston surface results in higher relative performance than prior hammers having a cylinder sleeve. The hammer design insures that all pressurized air through a choke (11) in the supply passage (27) of the flow tube (5) passes directly to the exhaust passage (29) of the drilling bit (6) and not to the space (6) above the piston (26). Such design also increases hammer performance because bypass pressure does not increase back pressure of the hammer (100). The piston (26) is constructed to move longitudinally downwardly with the bit as the hammer is lifted from the bottom of a bore hole. It is also cooperatively constructed and arranged such that when the apparatus is lifted, all pressurized fluid not bypassed to the bottom of the hammer is conducted to the top of the piston (26) and then exhausted via the drill bit 16, thereby preventing reciprocation and possible piston damage while exhausting such fluid through the bit.

8 Claims, 1 Drawing Sheet

DOWN HOLE PERCUSSION DRILL APPARATUS

BACKGROUND OF THE INVENTION

1) Field of the Invention

This invention relates to air drilling apparatus used typically for drilling through earth formations. Such drilling apparatus is particularly used in forming holes in hard rock, such as granite in mining operations. Such apparatus is also used in drilling water wells in soft or hard rock. In particular the apparatus of the invention relates to a down hole percussion drill, commonly called a pneumatic hammer, rock drill, hammer drill, impact tool, and the like.

2) Description of the Prior Art

Many prior art down hole pneumatic hammers have included an air distributor at the top portion of a casing with a piston adapted to reciprocate between the distributor and a drilling bit placed at the bottom of the casing. Top and bottom finger valves cooperate with the piston to distribute pressurized supply air first beneath the piston and, alternately, above the piston.

One prior art hammer is described in a paper entitled, "Hammer Drill Reduces Air Drilling Costs" by Walter E. Liljestrand of Mission Manufacturing Company, Houston, Tex., presented to the 19th Annual Meeting of the American Associates of Oilwell Drilling Contractors, Oct. 13, 1959 at Oklahoma City, Okla. Such hammer has a casing with a piston having a top portion and a lower portion. The upper portion of the piston is smaller in diameter than is the lower portion of the piston. Supply air is channeled in an annulus about a relief tube through the center of the piston. For a given outside diameter of the casing, the top end of the top portion of the piston is limited in area due to the reduced diameter of the upper portion of the piston. Accordingly, the performance of such hammer, for a given level of pressure of the pressurized air supply entering the hammer, is limited.

Another prior art hammer is described in U.S. Pat. No. 4,084,646 issued Apr. 18, 1978 and assigned to Ingersoll-Rand Company. Such hammer includes a top sleeve disposed between the drill casing and the piston to channel supply air from a distributor at the top of the hammer to the bottom end of the piston. The Ingersoll-Rand hammer, like the Mission hammer, includes both top and bottom finger valves, and requires a reduced diameter of the upper part of the piston to slide within the top distributing sleeve. Again, the smaller surface of the top end of the piston, for a given outer diameter of the casing and for a given air supply pressure, prevents the hammer from operating at optimum performance.

Other features of the prior art hammers described above have contributed to less than ideal performance. For example, a choke placed in an axial passage way of the Ingersoll-Rand hammer feeds a portion of the bypassed air pressure periodically to a position above the top end of the piston. Such bypassed air pressure increases the back pressure of the drill and decreases its performance somewhat.

Another example concern the operation of the hammers when they are lifted from the bottom of the hole. Such hammers are constructed such that continuing reciprocation of the hammer may continue with possible damage to the piston.

IDENTIFICATION OF OBJECTS OF THE INVENTION

A primary object of the invention is to provide a percussion down hole hammer having improved performance characteristics for a predetermined outer hammer diameter and predetermined air supply pressure.

Another object of the invention is to provide a novel flow-tube or air distributor which enhances performance characteristics of the hammer in which it is used.

Another object of the invention is to provide a hammer casing having a minimum inner bore diameter with a piston having an upper portion which is adapted for sliding surface to surface contact within such inner bore diameter of the casing.

Another object of the invention is to provide a seating surface for a flow tube air distributor inside the casing that does not rely on counter bores within the casing bore.

Another object of the invention is to provide a design in which a choke for the hammer which does not direct bypassed air pressure to the top of the piston, with the result that back pressure is reduced and hammer performance is enhanced.

Another object of the invention is to provide more efficient venting of exhaust fluid of the hammer resulting is less demand for air volume from a supply of pressurized air via a drilling string.

Another object of the invention is to provide a hammer which efficiently supplies full air supply pressure to an exhaust port of the bit when the drilling string is lifted from the bottom of the drill hole, with the piston being prevented from further reciprocation while the bit is not on the bottom of the drill hole.

SUMMARY

The objects as identified above, along with other advantages and features of the invention are incorporated in a percussion drill apparatus or hammer having an outer casing with a chuck attached at its top end and an impact receiving device or bit at its bottom end. The term "top" throughout this specification refers to the end of the hammer attached to a drill string which supplies pressurized air from a supply at the surface of the drilling equipment. The term "bottom" refers to the opposite end of the hammer to which the drilling bit is attached. Of course, the hammer may be used in drilling holes in the mining industry, and indeed such holes may be in an upward direction. Nevertheless, the art of pneumatic hammers refers to the supply end of the hammer as "top" and the bit end of it as "bottom".

The hammer has a reciprocating piston within the casing. An air distributor, called here a flow tube, cooperates with structural features of the casing inner bore, the piston outer diameter and a foot valve of the bit which extends upwardly into the casing bore, to alternately apply pressurized fluid from the drilling string via the top chuck to above and beneath the piston. As a result, the piston reciprocates within the casing and strikes the bit with great force on each downward stroke. An important feature of the structure of the flow tube, casing and piston is that the flow tube is maintained within the casing bore by means of a high strength steel ring disposed in a groove within the top part of the casing. As a result, the casing inner bore has a minimum inner diameter which is adapted for sliding surface to surface contact with the upper portion of the piston. Accordingly, the casing thickness may be greater, and the area on the top end of the piston may be larger than prior art down-hole pneumatic hammers. These increased dimensions in casing thickness and top-end piston area, for a predetermined outer casing diameter, translate into increased capability of the hammer to accept higher air pressures and increased performance for a given air pressure.

The flow tube of the hammer includes cylindrical upper and lower portions. The upper portion has a diameter adapted to substantially match the inner diameter of the casing. A lower portion of the flow tube is coaxial with the upper portion, but has an outer diameter which is smaller than the top portion. The piston of the hammer has an inner bore that reciprocates along the lower portion of the flow tube. The flow tube has a bore that runs from its top end to its bottom end. A wall divides the bore into a supply passage and exhaust passage. A plate closes the exhaust passage at its top end. A reduced diameter section of the lower portion as well as holes in the lower portion, one in the supply passage portion wall, the other to exhaust passage portion wall, cooperate with the piston structure and the casing inner diameter profile to distribute alternately the supply air to beneath the piston and above it for reciprocation.

An important feature of the invention is the placement of a choke for the bypassing of a predetermined amount of the air supply pressure in the supply passage. The choke is placed at the end of such supply passage. The flow tube, piston and casing inner diameter profile are arranged such that such bypassed pressurized air never is directed above the piston. As a result the back pressure against the top of the piston on its upward stroke is reduced, resulting in enhanced performance of the hammer.

Another important feature of the invention is the structure which allows the piston to move downwardly with the bit as the hammer casing is moved upwardly from the bottom of the hole. The outer diameter profile of the piston, the flow tube and the inner diameter profile of the casing are arranged such that full air supply pressure is exhausted constantly when the drilling string is lifted. Simultaneously the piston is prevented from reciprocation. Prevention of reciprocation of the piston during such operation prevents possible damage of the piston striking sufaces other than the top of the bit.

BRIEF DESCRIPTION OF THE DRAWINGS

The objects, advantages and features of the invention will become more apparent by reference to the drawings which are appended hereto and wherein like numerals indicate like elements and wherein an illustrative embodiment of the invention is shown, of which.

DESCRIPTION OF THE INVENTION

Figure 1:
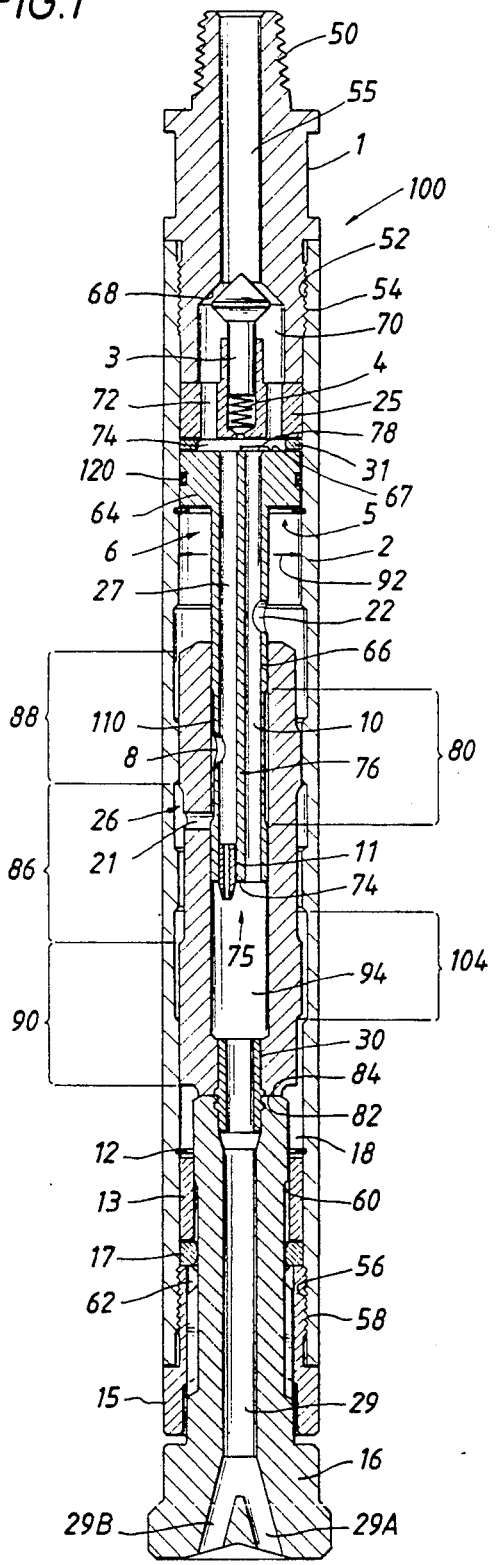
FIG. 1 is a cross section of a drilling apparatus of the invention with the piston in its extreme downward position striking the drill bit, the figure drawn with the bit being in its drilling position.
Figure 2:
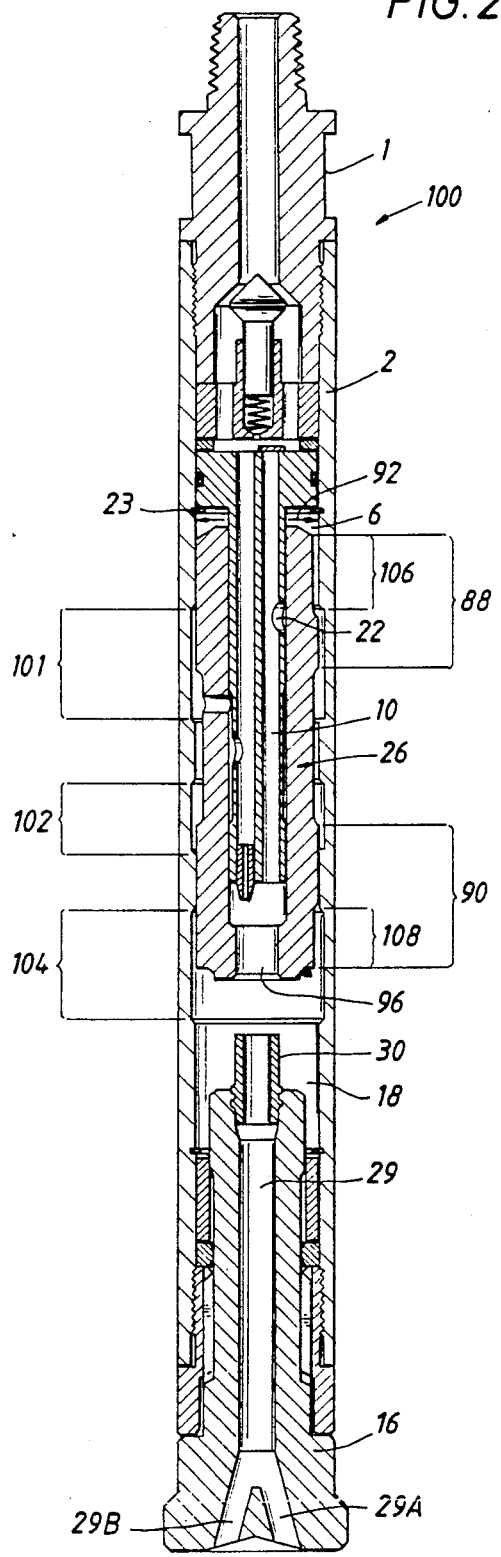
FIG. 2 is a cross section of the drilling apparatus with the piston in its extreme upward position within the casing, the figure also being drawn with the bit in its drilling position.

The downhole percussion drilling apparatus 100 illustrated in FIGS. 1 and 2 is commonly called a "rock drill", "hammer drill", "pneumatic hammer", or "impact tool". Such apparatus is used for drilling through rock, often hard rock such as granite. It of course may be used to drill through "softer" sedimentary rock strata of shales, sandstone, limestone and the like. The apparatus often finds application in the mining industry and in water-well drilling.

The orientation of the apparatus will be clear to people in the art of downhole pneumatic hammers. The hammer and bit shown in FIGS. 1 and 2 are in the position that the bit assumes while it is on the bottom of a bore hole being drilled. The bore hole is not illustrated for the sake of clarity. A more detailed description of the bit and its securement and relative position to the casing when the hammer is lifted off bottom is described below in this specification.

The drilling apparatus or "hammer" 100 includes a casing 2 having a drilling bit 16 secured at its bottom end and a top chuck 1 secured at its top end. The top chuck 1 serves to connect the hammer 100 to a drill string, and via the bore of the drill string, to a source of pressurized fluid, preferably air. The apparatus 100 of the invention operates for a wide variety of air pressures, for example 100 to 350 pounds per square inch (psig). The piston of the drilling appartus may operate at pressures lower than 100 psig, but such low pressures may be insufficient for the apparatus to penetrate hard rock strata effectively.

The top chuck 1, also known as a "backhead coupling", can be a wide variety of shapes and structures. The preferred top chuck for apparatus 100 includes top threads 50 adapted to connect to a drill string and bottom male threads 52 adapted to mate with female threads 54 of casing 2. An axial bore 55 within top chuck 1 provides an air path from the drilling string.

A percussion bit 16 is secured at the bottom end of the casing 2 by means of a bottom chuck 15 which has its threads 56 engaged with female threads 58 at the bottom end of casing 2. An exhaust passage 29 extends axially through bit 16 and terminates at the bottom end with one or more angled exhaust passages 29A, 29B. A male foot valve seat 30 is provided at the top part of bit 16 and faces upwardly into the interior bore of casing 2.

The bit 16 is axially aligned within casing 2 by means of alignment bushing 13. A split ring 17 retains the bit 16 within casing 2 when the bit 16 is impacted downwardly during drilling and when the apparatus 100 is lifted of the bottom of the hole. The split ring 17 cooperates with shoulder 60 of bit 16 extends downwardly with respect to casing 2, shoulder 60 stops at ring 17 and is prevented from further downward relative translation.

The alignment bushing 13 insures proper alignment of the drill bit 16 axis with the axis of casing 2. Such alignment is necessary to prevent damage to the foot valve seat 30. Alignment bushing 13 also prevents or limits loss of fluid pressure from the "bottom volume" 18 between the casing 2 and the bottom of piston 26. The bit 16 includes grooves or splines (not illustrated) in which bottom chuck 15 guides 62 are placed so that bit 16 may move axially with respect to bottom chuck 15 and casing 2, but not rotationally.

A piston retaining ring 12, disposed in a groove within the inner diameter of casing 2 retains piston 26 within casing 2 when the lower chuck 15 and bit 16 are removed, as when replacing the bit 16. The piston retaining ring 12 also serves to prevent further relative translation of the piston when the entire drill 100 is pulled off the bottom of a bore hole by the drill string attached to top chuck 1. The functioning of the piston retaining ring 12 in preventing piston reciprocation during such a procedure is explained below.

A flow tube 5 is disposed in the upper part of casing 2. Flow tube 5 includes an upper portion 64 and a lower portion 66. The upper portion 64 rests upon steel retaining ring 23 disposed in a groove within the inner diameter of the casing 2. A make up ring 31 rests upon the top end 64 of flow tube 5. A back flow valve housing 25 rests on top of make-up ring 31. Top chuck 1 is forced downwardly against the top of back-flow valve housing 25 as the threads 52 of top chuck 1 are made up with threads 54 of casing 2. Back flow valve 3 is forced upwardly by spring 4 in order to close against seat 68 of supply passage 55 of top chuck 1. As long as the supply pressure in passage 55, exceeds the closure force of spring 4 and any back pressure within the housing 25 that may have entered via bit 16, valve 3 is forced downwardly and pressurized air via supply passage 55 enters cavity 70 in top chuck 1 and holes 72 of back flow valve housing 25. Such pressurized air also enters the space 74 above flow tube 5 inside make up ring 31.

Flow tube 5 includes upper portion 64 and lower portion 66. Preferably, but not essential to this invention, upper portion 64 and lower portion 66 are integral with each other. Upper portion 64 includes an "O" ring 120 in its cylindrical wall to seal the flow tube 5 to the inner bore of casing 2. Such "O" ring is preferably fabricated of Butadiene Acrylonitrile elastomer. It prevents entry of supply pressurized air to the top space 6 of the hammer.

Upper portion 64 and lower portion 66 have a common bore 75 extending along the axis of the integral member from top end 67 to bottom end 74. A wall 76 is placed within bore 75 thereby creating a supply passage 27 and an exhaust passage 10. Preferably, wall 76 divides bore 75 into two equally sized passages. The top of exhaust passage 10 is closed off by plate 78 which is preferably secured in place by welding it to the top of wall 76 and the surrounding portion of top end 67 of upper portion 64 of flow tube 5.

The lower portion 66 of flow tube 5 includes a reduced diameter section 80. A top vent or "port" or "hole" 22 is placed in the cylindrical wall portion of the exhaust passage 10. Such vent 22 is disposed above the reduced diameter section 80 of lower portion 66 of flow tube 5.

A choke or "air flow controller" 11 is placed at the bottom end of supply passage 27. Choke 11 may have an orifice in it as illustrated in FIGS. 1 and 2, or it may be a blank choke whereby no supply pressurized air is bypassed via the choke to exhaust passage 29 of bit 16 (The bottom end of supply passage 27 has a slight reduced inner diameter, such that choke 11 is maintained in the end opening of supply passage 27. Alternatively, a plate may be welded to the bottom face of lower portion 66. A conical hole in such plate retains the choke 11). The supply pressure in passage 27 forces the choke downwardly and maintains it in the bottom of passage 27 during operation of hammer 100.

The piston 26 is adapted for reciprocation within casing 2 and for striking the top annular end 82 of bit 16 with piston bottom end 84. Piston 26 has a top portion 88 and bottom portion 90, each of which has an outer diameter which substantially matches the minimum inner diameter 92 of casing 2. In other words, piston 26 is adapted to slide with surface to surface contact along casing bore surfaces which have a minimum bore dimension. Lubrication for such sliding contact is provided by lubrication particles entrained in the supply of pressurized air.

Piston 26 includes a reduced diameter middle portion 86 between upper and bottom piston portions 88, 90. A piston hole or "port" or "vent" 21 is placed in the piston wall in the reduced diameter middle section 86. Piston port 21 is preferably formed perpendicularly to the axis of piston 26. Likewise, ports 22 and 8 in exhaust and supply passages 10, 27 are preferably formed at right angles to the axis of flow tube 5. Piston port 21 and ports 22, 8 could be formed at angles other than a right angle to the axis of piston 26.

Piston 26 includes an internal axial bore 94 which has an inner diameter which substantially matches the outer diameter of lower portion 66 of flow tube 5. As best seen in FIG. 2, a reduced inner diameter bore 96 at the bottom end of bottom portion 90 of piston 26 substantially matches the outer diameter of male foot valve member 30 of bit 16. Accordingly, the bore 94 of piston 26 is adapted for reciprocation about lower portion 66 of flow tube 5 and the reduced diameter bore 96 is adapted for alternately sealing and opening with male foot member valve 30 of bit 16.

The outer periphery of top part 106 of top portion 88 (see especially, FIG. 2 for such reference number) of piston 26 includes longitudinal lands or "flats" or grooves formed on it to provide passage ways for pressurized air when the top portion 88 is adjacent a minimum inner diameter section of casing 2. Likewise, the outer periphery of bottom part 108 of bottom portion 90 includes longitudinal "lands" or "flats" or grooves on it to provide a passage way for pressurized air when bottom portion 90 of piston 26 is adjacent a minimum inner diameter section of casing 2.

The casing 2 of drilling apparatus or hammer 100 includes a minimum inner diameter bore 92. Internal top threads 54 are formed on such minimum inner diameter as are bottom internal threads 58. Advantageously, there are no counter bore segments within casing 2, that is, a longitudinal section having a smaller inner diameter than the minimum diameter as indicated by reference arrow 92. Sections of greater inner diameter are provided along the axial extent of the casing. An upper section 101, middle section 102 and lower section 104 are provided of increased inner diameter compared to minimum inner diameter 92 of the remainder of the casing 2.

OPERATION DURING DRILLING

The piston 26 reciprocates within casing 2 and about lower portion 66 of flow tube 5 when pressurized air is supplied via supply passage of top chuck 100. FIGS. 1 and 2 illustrate the orientation of the piston 26 during its cycle. FIG. 1 illustrates the location of piston 26 at the bottom of its stroke as its bottom end 84 strikes top end or anvil 82 of bit 16. FIG. 2 illustrates the location of piston 26 at its upper extreme position within casing 2.

Referring now specifically to FIG. 1, pressurized air enters via supply passage 55 of top chuck 1 and depresses backflow valve 3 against the upward force of spring 4. Pressurized air travels through passages 70 of top chuck 1 and then through holes 72 which are preferably machined in housing 25. Backflow valve 3 is adapted to reclose upon loss of pressure to prevent down-hole water from backing up into supply passage 55.

Pressurized air then passes into the center region 74 of make up ring 31. Such pressurized air is blocked from exhaust passage 10, but freely flows via supply passage 27 of flow tube 5. The supply pressurized air exits via lower port 8 and enters a first high pressure reservoir 110 defined between the inner diameter of bore 94 of piston 26 and the outer diameter of reduced diameter section 80 of lower section 66 of flow tube 5.

The piston port 21 communicates with first high pressure reservoir 110 and a second high pressure reservoir which includes the space between the outer diameter of reduced diameter section 86 and the inner diameter profile of casing 2 which at any time is opposite piston 26. The extend of such second high pressure reservoir in volume and location. For example, with the location of piston 26 in the position relative to casing 2 in FIG. 1, the second high pressure reservoir extends between external piston and internal casing profiles from the top of middle portion 86 of piston 26 to the piston retaining ring 12. With the location of piston 26 in the position relative to casing 2 in FIG. 2, the second high pressure reservoir extends between external piston and internal casing profiles from the bottom of middle increased inner diameter section 102 of casing 2 to the mounting ring 23. Accordingly, regardless of the reciprocating position of piston 26 with respect to casing 2, a high pressure reservoir exists (1) adjacent the interior bore 94 of piston 26 and the reduced diameter section 80 of lower portion 66 of flow tube 5 and (2) at least the space between the inner profile of the casing 2 and the outer diameter of middle section 86 of piston 26. The combined reservoirs of high pressurized air to the hammer 100 contributes significantly to its high performance.

When the piston 26 is in its lower position as illustrated in FIG. 1, pressurized air proceeds from middle section 86 of piston 26 to the space between the outer diameter profile of piston 26 and increased diameter section 104 of the casing 2. From that space, such pressurized air travels along the "lands" or flats 108 to space 18 below end 84 of piston 26. As the volume of the space 18 is filled with pressurized air, the pressure under piston 26 increases suddenly and the piston 26 begins to rise rapidly off the top anvil surface 82 of drill bit 16.

While piston 26 is in its lower position as illustrated in FIG. 1, any pressurized air remaining in top space 6 exits the hammer 100 via top vent 22 to exhaust passage 10 of lower portion 66 of flow tube 5. Next, such air is passed to bore 94 of piston 26 and then to foot valve 30 of bit 16 and finally out the bottom of bit 16 via exhaust passages 29 and 29A, 29B.

As the piston 26 rises to its ultimate height, as illustrated in FIG. 2, bottom feeding of pressurized air is prevented when the maximum outer diameter section of the bottom portion 90 of piston 26 reaches the minimum bore inner diameter profile of the casing 2 which exists between increased bore inner diameter sections 101 and 102.

As the piston 26 rises within casing 2, the top portion 88 covers top vent 22 in exhaust passage 10 of flow tube 5. Also the foot valve 30 is uncovered by reduced diameter bore 96 of piston 26. As a result, the air pressure beneath piston 26 rapidly exhausts via exhaust passage 29 of bit 16. As the piston 26 continues to rise, supply pressurized air is directed via flats 106 and the region adjacent increased diameter portion 101 of casing 2 to top space 6, where it is compressed. Its pressure is increased as the volume of space 6 decreases with the rise of piston 26.

The top of piston 26 now has high pressure air acting on its top surface and low pressure air remaining at its bottom surface. The direction of travel of the piston reverses before its top end reaches retainer ring 23 and starts downwardly. Piston 26 is propelled downwardly with great force toward the drill bit 16. Of course, the terms top and bottom are for convenience in describing the apparatus. The apparatus 100 operates in any orientation. The force of gravity as it acts on piston 26 within casing 2 is negligible as compared to the forces generated by the supply fluid pressure acting on the top and bottom surfaces of the piston 26.

During downward travel of the piston 26, a point is reached where the reduced diameter 96 of the bore of piston 26 meets and begins to slide over the outside diameter of the foot valve 30. The volume of space 18 called the "bottom volume", below the piston 26 decreases as the piston continues its downward travel. As the piston continues downward, port 22 is uncovered by the piston 26. The pressurized air in top space 6 is rapidly exhausted via exhaust passage 10, foot valve 96 and bit exhaust passage 29. The piston strikes bit 16 due to the momentum of its downward travel and any positive pressure differential that may exist between top and bottom surfaces of piston 26. The exhausting air via bit exhaust passages 29, 29A and 29B provides a means for removing cuttings from the hole being drilled.

At a position before its extreme downward travel, piston 16 closes upward supply pressure feed past the minimum inner diameter profile between increased inner diameter sections 101, 102 of casing 2. Likewise, piston 16 opens downward supply pressure feed past the minimum inner diameter profile between increased inner diameter sections 102 and 104.

The cycle described above repeats automatically. Its frequency of operation depends upon the volume and pressure of the pressurized supply air applied to the tool.

OPERATION WITH CHOKE IN SUPPLY PASSAGE

Choke 11, sometimes called an "air flow controller", may optionally be placed in the supply fluid passage 27 to enhance the operation of hammer 100. If full capacity of the pressurized fluid from top chuck supply passage 55 is to be used, a blank choke 11 may be employed to prevent any bypassed pressure from flowing through the choke. Accordingly, the entire supply fluid from supply passage 27 of flow tube 5 exits via port 8 and is used in the reciprocation of piston 26.

If the capacity of the air compressor which supplies air to passage 55 via a drill string is too large, the pressure in the hammer 100 may rise above the pressure capacity limits of the compressor. A choke 11 containing a small orifice may be used as illustrated in FIGS. 1 and 2 to bypass a portion of the supply air through the hammer with no work being done by such bypassed air. The use of a choke 11 is also advantageous when water wells are drilled where large amounts of water must be removed from the bore hole while drilling. The size of the orifice in choke 11 is selected by the driller.

OPERATION OF HAMMER WHEN PULLED FROM HOLE BOTTOM

Sometimes during a drilling operation, the annular space between the outer diameter of the hammer 100 and the inner diameter of the bore hole becomes excessively filled with rock chips, water and the like. This occurs especially when soft rock is being drilled. Sandstone boring, for example, may generate more cuttings than can be removed by the exhaust air. Also, water may enter the bore hole, which with excessive cuttings is difficult to remove while drilling at full capacity.

Changing the choke 11 to one with a larger orifice allows more supply fluid to be bypassed directly through the drill bit 16. However, it is time consuming to "round trip" the drill string to bring the hammer to the surface for the purpose of changing the choke and then returning the bit and hammer to the bottom of the bore hole. Accordingly, another feature of the hammer 100 according to the invention eliminates the need for changing the choke.

Referring again to FIG. 1, when the drill string is raised a small distance in the bore hole, the casing 2 is raised relative to bit 16. The bit 16 translates downwardly by the distance from shoulder 60 of bit 16 to split retaining ring 17. As a result, piston 26 follows bit 16 downward with respect to casing 2. In so doing, the upper part of the bottom section 90 of piston 26 cooperates with the minimum inner diameter part of the casing immediately below bottom increased inner diameter section 104 to prevent pressurized supply air to feed to below piston 26. Simultaneously, the supply air is fed to top space 6 via piston port 21 and the lands on the top portion of piston 26 adjacent the minimum inner diameter section between increased inner diameter sections 101 and 102. Accordingly, supply air enters port 22 and exhausts directly to the exhaust passages 29, 29A, 29B of the bit 16 via exhaust passage 10 of the flow tube 5 and the foot valve 30.

The structure described above causes the piston 26 to immediately cease reciprocation when the drill string is pulled upwardly a small distance and causes full supply pressure to be bypassed to the bit exhaust. No time consuming changing of chokes is required. The damaging effects of continuing piston reciprocation upon raising of the drill string with full supply pressure applied to the drill string, as sometimes experienced with prior hammers, are eliminated.

Various modifications and alterations in the described methods and apparatus will be apparent to those skilled in the art of the foregoing description which does not depart from the spirit of the invention. For this reason, these changes are desired to be included in the appended claims. The appended claims recite the only limitation to the present invention. The descriptive manner which is employed for setting forth the embodiments should be interpreted as illustrative but not limitative.

What is claimed is:

1. A down hole drilling apparatus comprising, a casing (2) having an inner bore having a minimum inner diameter (92), said casing having a top end and a bottom end, a top chuck (1) removably secured to the top end of said casing and adapted to connect said drill apparatus to a drill string and a source of pressurized fluid, a drill bit (16) removably secured to said bottom end of said casing, a reciprocating piston (26) having a top end and a bottom end disposed within said casing with said piston adapted to impart a blow on said drill bit, said piston having a top portion (88) and a bottom portion (90), said top portion and said bottom portion of said piston having an outer surface which slides with surface to surface contact with said minimum inner diameter of said inner bore of said casing, a flow tube (5) having top and bottom ends with its top end secured within said casing bore (92) toward said top end of said casing, said flow tube (5) having supply (27) and exhaust (10) air passages, said supply air passage of said flow tube being open at its top end to receive pressurized fluid from said top chuck, said exhaust air passage of said flow tube being closed at its top end to prevent direct flow of pressurized fluid through said exhaust air passage from said top chuck, said piston (26) having a central bore (94) in which a portion of said flow tube is disposed, said central bore (75), said casing (2), and said flow tube (5) dimensioned for said piston (26) to reciprocate within said casing (2) and about said flow tube (5), and fluid passage means in said piston (26) casing (2) flow tube (5) and drill bit (16) cooperatively arranged for alternately applying pressurized supply fluid from said supply passage to the bottom end of said piston for forcing it upward while exhausting fluid pressure above said piston, when said piston is in a bottom position within said casing, and applying pressurized supply fluid from said supply passage to above the top end of said piston for forcing it downward while exhausting fluid pressure below said piston, when said piston is in a top position within said casing, said fluid passage means in said piston (26), casing (2), flow tube (5), and drill bit (16) including, a reduced outer diameter section (80) of said flow tube toward its bottom end, a lower hole (8) in said reduced outer diameter section of said flow tube which communicates solely with said supply air passage (27), an upper hole (22) in said flow tube toward its top end which communicates solely with said exhaust air passage (10), a reduced outer diameter section (86) of said piston (26) between a top portion (88) and a bottom portion (90), a hole (21) in said reduced outer diameter section (86) of said piston (26), upper (101), lower (104), and middle (102) increased inner diameter sections of said inner bore of said casing (2), a male foot valve member (30) extending upwardly in said casing bore from said drill bit (16), an inner bore member (96) facing downwardly on said bottom section (90) of said piston, and flats formed on a portion of said upper section (88) of said piston and on said lower section (90) of said piston (26).

2. The apparatus of claim 1 in which said flow tube includes an upper section (64) having an outer diameter adapted for sliding fit within said minimum inner diameter (92) of said casing, and a lower section (66) of smaller outer diameter, said exhaust air passage (10) and said supply air passage (27) extending through said upper and lower sections of said flow tube.

3. The apparatus of claim 2 in which said exhaust air passage (10) and supply air passage (27) are separated by a separating wall (76) placed within a longitudinal bore through said upper section and said lower section of said flow tube.

4. The apparatus of claim 3 wherein said exhaust air passage is closed at its top end of said flow tube by a plate (78) secured to a top end of said upper section and to said separating wall.

5. The apparatus of claim 2 further including a retaining ring (23) disposed in a groove within said inner bore, with said flow tube upper section (64) disposed within said casing (2) and seated upon said retaining ring.

6. The apparatus of claim 5 further including a back flow valve housing (25) placed above said upper section of said flow tube with a portion of said top chuck (1) bearing downward against said back flow valve housing, whereby said flow tube is securely sandwiched between said backflow valve housing and said retaining ring.

7. The apparatus of claim 1 wherein, said upper (22) and lower (8) holes of said flow tube are formed perpendicularly to a longitudinal axis of said flow tube and said casing.

8. The apparatus of claim 1 wherein, said hole (21) in said piston (26) is formed perpendicularly to a longitudinal axis of said flow tube and said casing.

* * * * *